US006735896B1

(12) United States Patent
Zager

(10) Patent No.: US 6,735,896 B1
(45) Date of Patent: May 18, 2004

(54) DISPLAY DEVICE FOR SHEET MATERIAL

(76) Inventor: Marilyn V. Zager, 122 S. 10th St., La Crosse, WI (US) 54601

( * ) Notice: Subject to any disclaimer, the term of this patent is extended or adjusted under 35 U.S.C. 154(b) by 0 days.

(21) Appl. No.: 09/516,516

(22) Filed: Mar. 1, 2000

(51) Int. Cl.[7] ..... A47G 1/06
(52) U.S. Cl. ..... 40/711; 40/611.02
(58) Field of Search ..... 40/711, 594, 597, 40/600, 772, 611.02, 611.04

(56) References Cited

U.S. PATENT DOCUMENTS 4,381,616 A * 5/1983 Saxer ..... 40/502
5,893,229 A * 4/1999 Werner ..... 40/773

OTHER PUBLICATIONS

Fridge Frame, Inc., display–it.com Web Page, Nov. 16, 1999, 10 pages.
Fridge Fun! Inc, fridgefun.com Web Page, Nov. 16, 1999, 1 page.
The Artworks, the–art–works.com Web Page, Nov. 16, 1999, 2 pages.

* cited by examiner

*Primary Examiner*—Cassandra H. Davis
(74) *Attorney, Agent, or Firm*—Tipton L. Randall

(57) ABSTRACT

A display device for sheet material comprises a transparent front panel, a flexible backing sheet, and fastener for mounting the device on a surface without damaging the surface. The front panel has an outer dimension larger than the sheet material to be displayed, a central display section having a back surface for receiving the sheet material to be displayed, and a mounting section surrounding and extending outwardly beyond the perimeter of the display section. The backing sheet is adapted for holding the sheet material to be displayed against the back surface of the display section. At least one edge of the backing sheet is secured to the mounting section of the front panel. The fastener for mounting the device is connected to the mounting section and preferably includes at least one magnetic piece.

17 Claims, 8 Drawing Sheets

DISPLAY DEVICE FOR SHEET MATERIAL

BACKGROUND OF THE INVENTION

1. Field of the Invention

The present invention relates, generally, to display devices. More particularly, the invention relates to display devices for temporarily or removably mounting sheet materials such as pictures, art work and printed matter onto surfaces such as walls, refrigerators, cabinets, or doors.

2. Background Information

Teachers and parents often display their students' or children's creations of art by hanging them on walls, refrigerators, doors, file cabinets, kitchen cabinets and the like. Additionally, photographs and newspaper pictures and articles often are displayed in a similar manner.

The state of the art in general includes various devices and methods for hanging or otherwise displaying the sheets. Sheets typically may be hung on non-ferrous surfaces using pins, staples, tape and the like, or may be hung on ferrous surfaces by placing one or more magnetic pieces against the outer face of the sheet. The devices of the known art are believed to have significant limitations and shortcomings. Specifically, the outer face of the sheet material is completely exposed and vulnerable to being torn, soiled or accidentally knocked to the floor. Paper materials tend to "flap in the breeze," particularly when mounted on doors, or close to windows or fans. This exposure and motion may cause the materials to become distractive and/or unsightly.

This invention provides a display device which is believed to constitute an improvement over the known art.

BRIEF SUMMARY OF THE INVENTION

The present invention provides a display device for sheet materials which generally comprises a transparent front panel with an outer dimension larger than the sheet material to be displayed. The front panel has a central display section and a mounting section that surrounds and extends outwardly beyond the perimeter of the display section. The display device further includes a flexible backing sheet and mounting means connected to the mounting section of the front panel. At least a portion of a peripheral edge of the backing sheet is secured to the mounting section. The sheet material is held between the flexible backing sheet and the transparent front panel. The mounting means is adapted for temporarily or removably mounting the display device on a surface.

The display device may further include a frame connected to the mounting section of the front panel. The mounting means is connected to both the mounting means and the frame. The frame may be formed either from injection molded plastic or it may be stamped from foam rubber. The mounting means may include means for removably mounting the display device on a non-ferrous surface. For example, the frame may include threaded apertures adapted for receiving a suction cup or the frame may be formed with at least one hanger portion.

The mounting means may also include at least one magnetic piece connected to the mounting section and/or the frame to provide a means for removably mounting the display device on a ferrous surface. In a preferred embodiment, two magnetic strips are attached on opposite ends of the backside of the frame, preferably using a non-toxic adhesive such as rubber cement. These magnetic strips also serve to secure the edges of the front panel and the backing sheet to the frame, and adhesive tape may be used to secure the remaining edges of the front panel and backing sheet. The adhesive tape also ensures that the magnetic strips are secured to the frame.

The present invention provides an inexpensive display device for temporarily mounting sheet materials on surfaces. The display device protects and preserves the material without damaging the mounting surface, and is adapted for facilitating convenient removal and replacement of the material. Furthermore, the display device may include an attractive frame that is adapted for mounting on either ferrous or non-ferrous surfaces. Additionally, the display device is shatterproof because of its frame construction and the use of Mylar polyester film, and is non-toxic because of its adhesive.

The features, benefits and objects of this invention will become clear to those skilled in the art by reference to the following description, claims and drawings.

DETAILED DESCRIPTION

Figure 1:
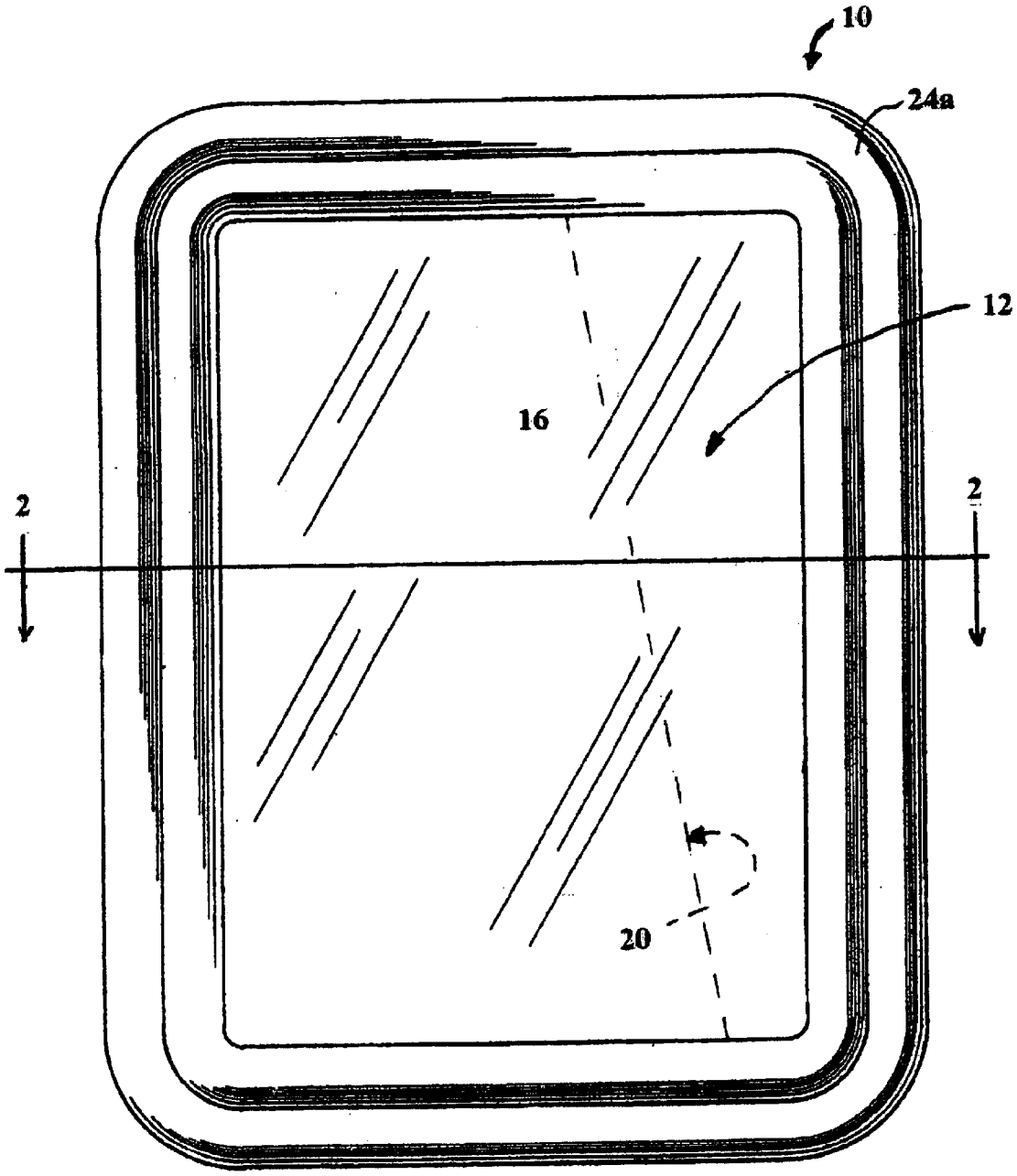
FIG. 1 is a front view of an embodiment of the display device with an injection-molded frame.

Referring to FIGS. 1–4, the display device 10 of the invention includes a transparent front panel 12 which has outer dimensions larger than the sheet material 14 to be displayed, such as a child's drawing on art paper, and further has a central display section 16 for receiving and viewing the sheet material 14. In the particular embodiment illustrated, the front panel 12 and the display section 16 are rectangular. Both can have other suitable geometric configurations. The display section 16 is at least as large as the sheet material 14.

The front panel 12 has a peripheral mounting section 18 which surrounds and extends outwardly beyond the perimeter of the display section 16. The sheet material 14 is held in place against the back surface of the display section 16 by a flexible backing sheet 20 which covers the display section 16. The backing sheet 20 and the front panel 12 preferably are made from a Mylar polyester film, allowing these elements to be soft, pliable and shatterproof. The backing sheet 20 effectively clamps the sheet material 14 against the back surface of the display section 16, and yet is flexible enough to facilitate an easy removable and replacement of the material.

Figure 2:
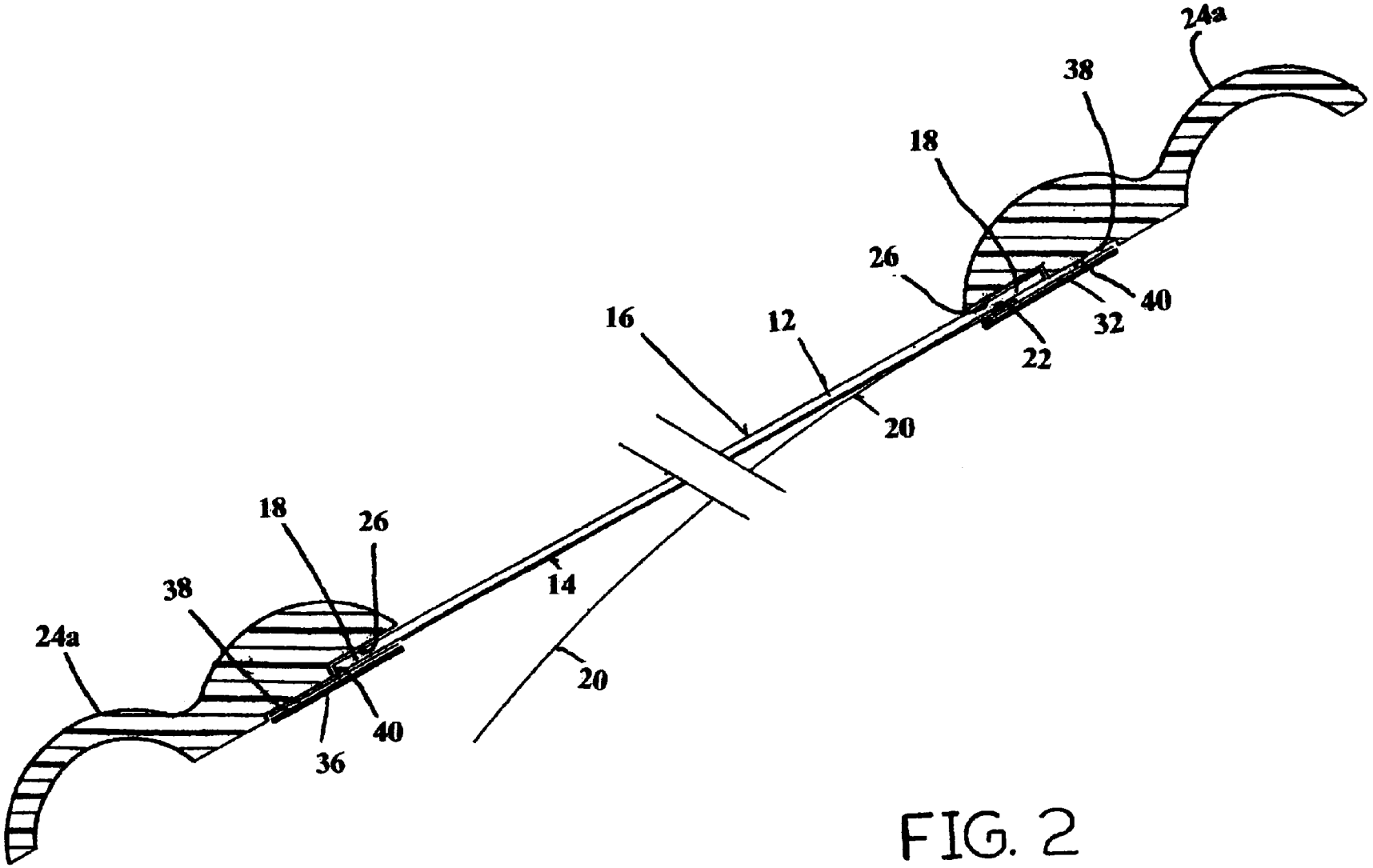
FIG. 2 is an enlarged sectional view taken generally along line 2—2 in FIG. 1, shown with a sheet material installed and the backing sheet partially raised.
Figure 3:
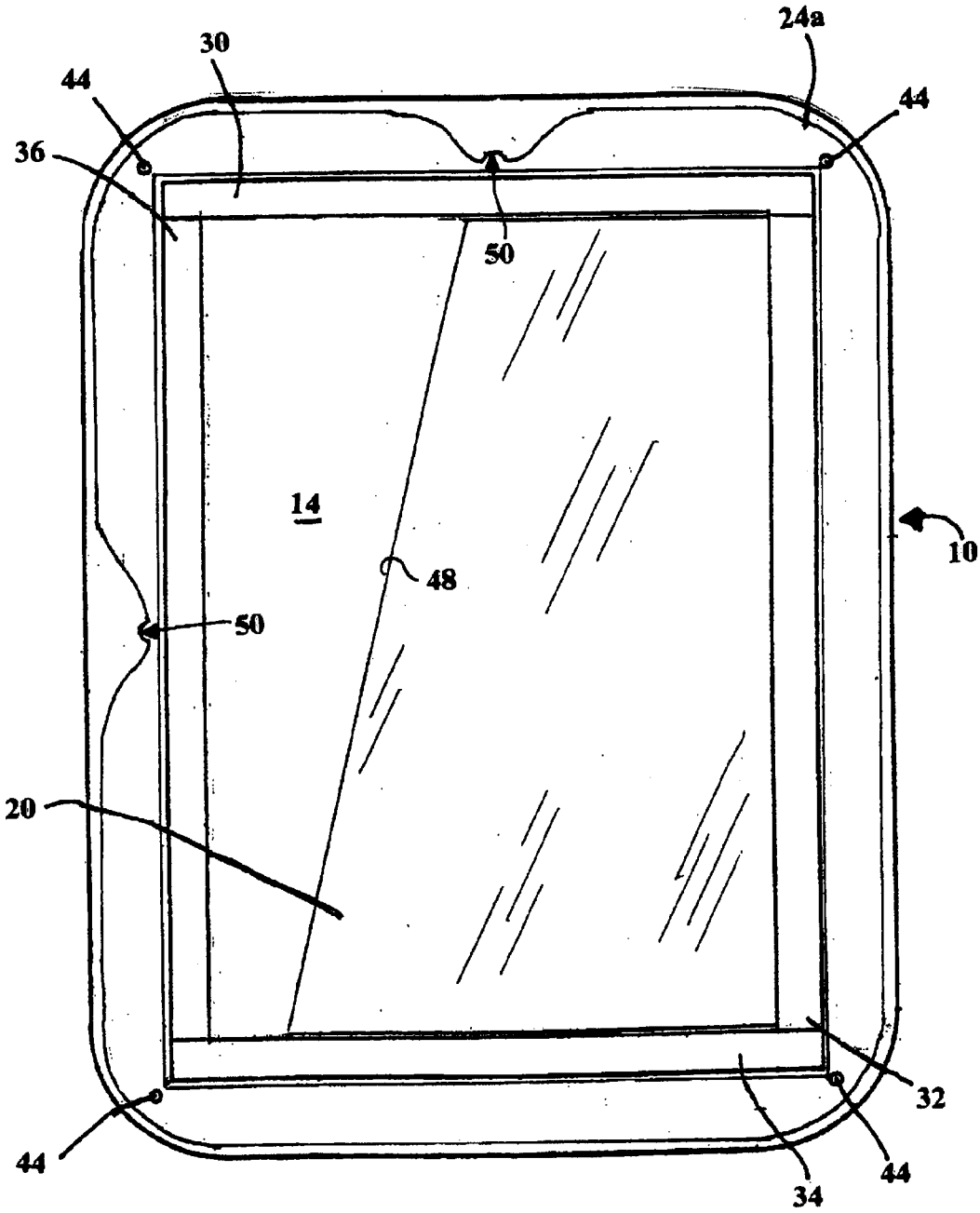
FIG. 3 is a rear view of the display device in FIG. 1.

The backing sheet 20 covers at least a portion of the display section 16 and, as best illustrated in FIG. 2, one edge 22 extends beyond the display section 16 and is secured to the mounting section 18 along one side of the display section 16. The backing sheet 20 may be opaque and colored, in which case it is desirable to cover the entire back of the display section 16, or the backing sheet 20 may be transparent similar to the front panel 12, in which case it is not necessary to cover the entire display section 12.

Means are provided on the mounting section 18 for mounting the display device 10 on a generally vertical surface without damaging the surface. In the specific embodiment illustrated in FIGS. 1–4, the display device 10 includes a rectangular, injection molded frame 24*a* having a first peripheral recess 26 on the back side in which the mounting section 18 of the front panel 12 is seated. The mounting means includes magnetic segments or strips 32 and 36 which are seated in a second peripheral recess 38 on the back side of the frame 24*a*. Each of the magnetic strips 32 and 36 extends along one side of the display section 16 and overlies the corresponding portion of the mounting section 18. The magnetic strips 32 and 36 are suitably secured to the frame 24*a* on the mounting section 18 of the front panel 12, such as by an adhesive 40. The adhesive is preferably a non-toxic adhesive such as rubber cement. The magnetic strip 32 extending along the right side of the display section 16, as viewed in FIG. 3, overlies both a portion of the corresponding mounting section 18 and a portion of the backing sheet edge 22 and is secured to both by the adhesive 40. Thus, the magnetic strips 32, 36 serve both as a means for mounting the device 10 on a ferrous surface and also as a retainer for the front panel 12 and one edge 22 of the backing sheet 20.

While the magnetic strips 32 and 36 extend substantially along the entire length of opposing sides of the display section 16 in the preferred embodiment illustrated in FIGS. 1–4, short segments of magnetic material, i.e. one or more magnetic piece, can be used in place of each magnetic strip by spacing them. The remainder of the sides are taped using adhesive tape strips 30 and 34 to retain the front panel 12. The tape strips 30 and 34 also serve as a retainer for the front panel 12 and the backing sheet 20.

The frame 24*a* is used primarily to enhance the overall aesthetic appearance of the device. In the embodiment shown in FIGS. 1–4, it preferably is injection molded using K-resin, a petroleum-based plastic, and includes one or more attractive color pigments. The frame 24*a* can be omitted, in which case narrower magnetic strips are used and they are secured only to the mounting section 18 of the front panel 12 and on edge 22 of the backing sheet 20. Furthermore, the frame 24 may be made from other material.

FIGS. 6–9 illustrate a display device 10 that includes a flexible foam rubber frame 24*b* that is stamped out using a rule die. The foam rubber frame 24*b* is non-toxic, soft and shatterproof. Similar to the injection molded frame 24*a* discussed above, the magnetic strips 32 and 36 and adhesive tape 30 and 34 serve as a retainer for the front panel 12 and the backing sheet 20, and the magnetic strips 32 and 36 also serve as a means for mounting the display device 10. In the embodiment shown in these figures, three out of the four sides of the backing sheet 20 are retained. The material 14 is slid behind edge 48.

Figure 5:
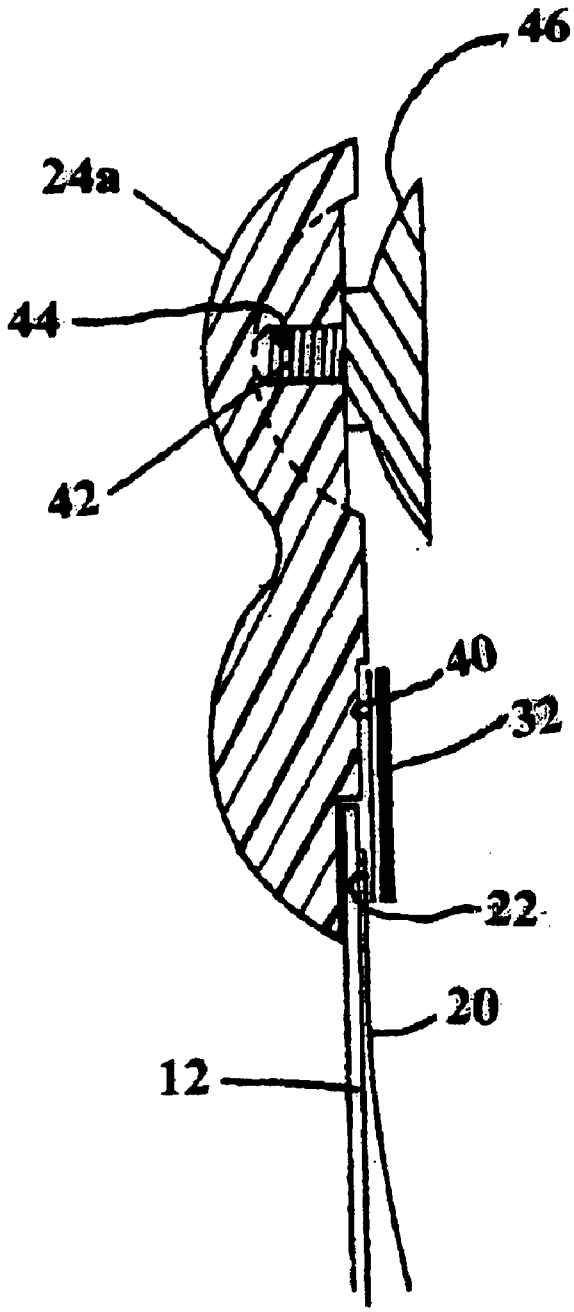
FIG. 5 is an enlarged, fragmentary view of an alternate embodiment including means for mounting the device on a non-ferrous surface.
Figure 6:
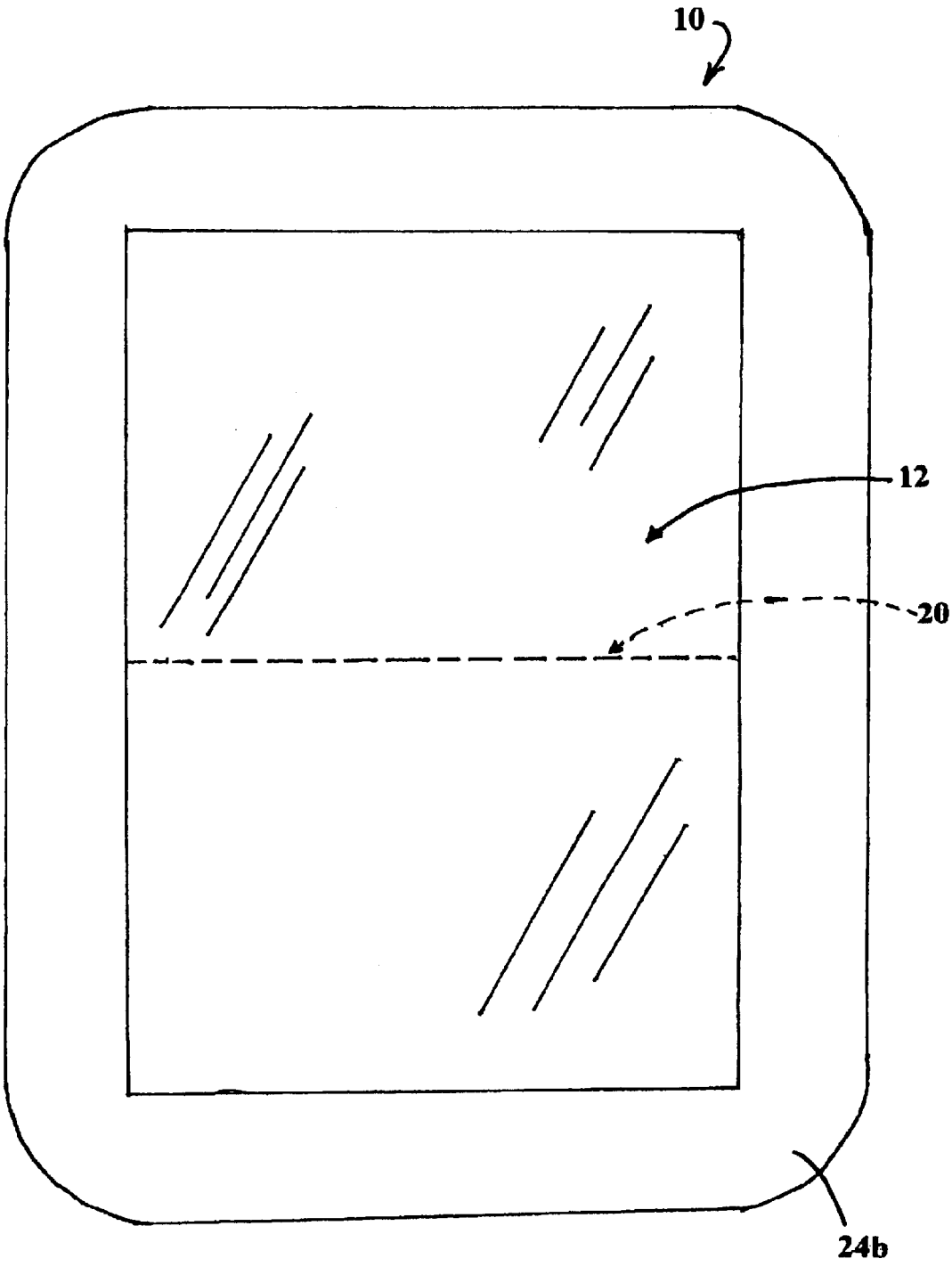
FIG. 6 is a front view of an embodiment of the display device with a stamped foam rubber frame.
Figure 7:
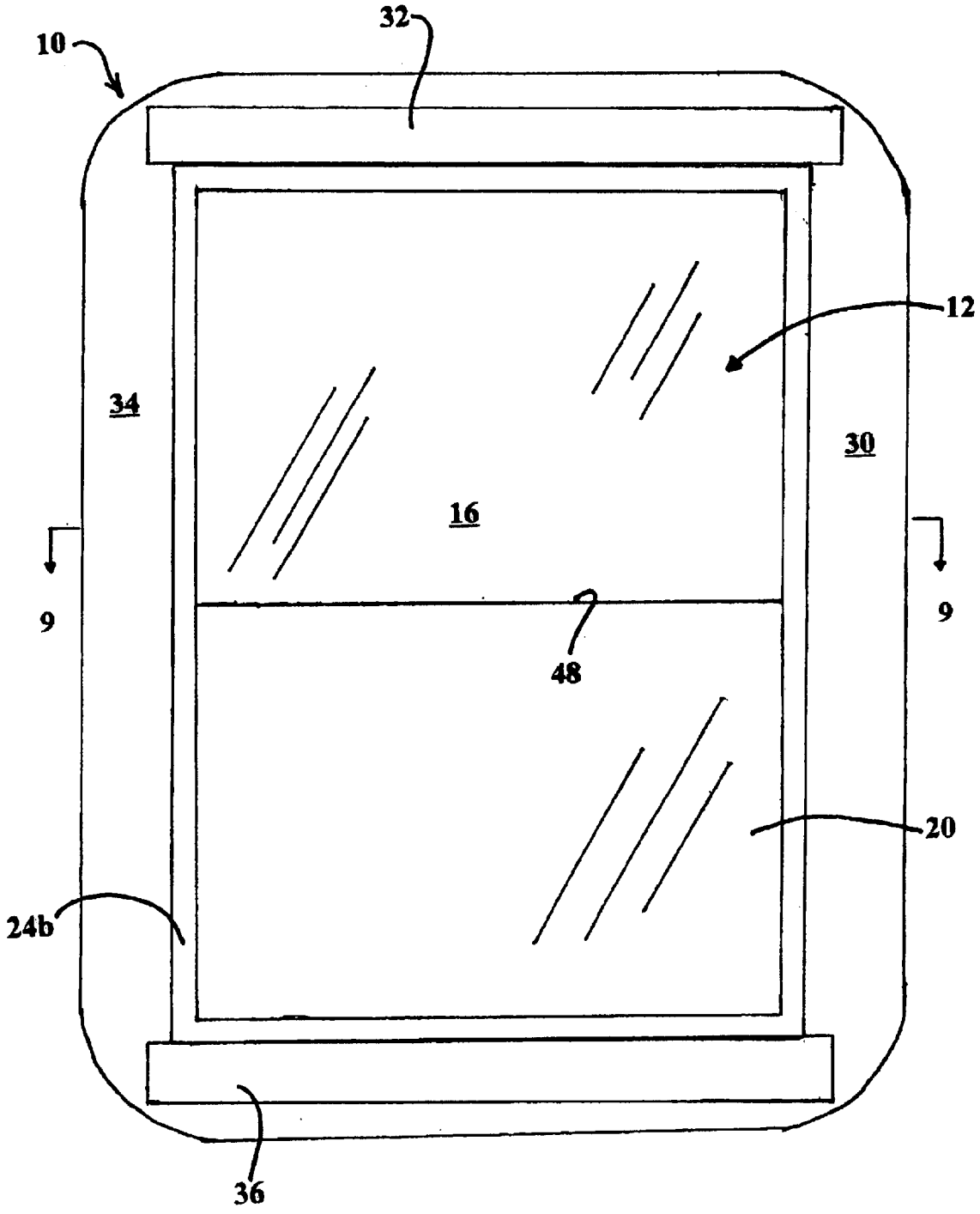
FIG. 7 is a rear view of the display device of FIG. 6.
Figure 8:
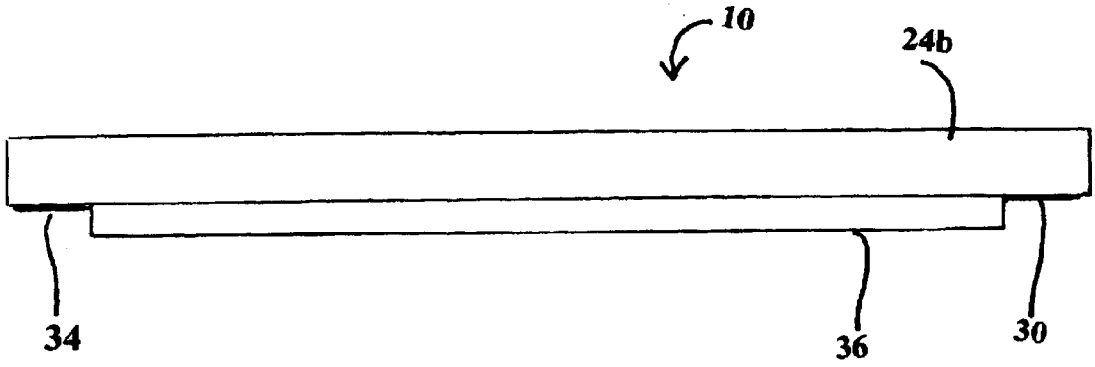
FIG. 8 is an end view of the display device of FIG. 6.

FIG. 5 illustrates an alternate embodiment including a plurality of suction cups 46 (one shown) removably mounted on the back side of the frame 24*a* or the mounting section 18 of the front panel 12 if the frame 24*a* is not used. The suction cups 46 can be used to mount the display device 10 on a relatively smooth non-ferrous surface, although they may be used on a smooth ferrous surface as well. Each suction cup 46 includes a threaded machine screw 42 which threads into an aperture 44 in the frame 24*a*. One suction cup 46 in each corner of the frame 24*a* usually is sufficient. When the display device 10 is to be mounted on a ferrous surface, the suction cups 46 are removed by unscrewing the suction cup 46 with the machine screws 42 from the frame 24*a*.

Figure 4:
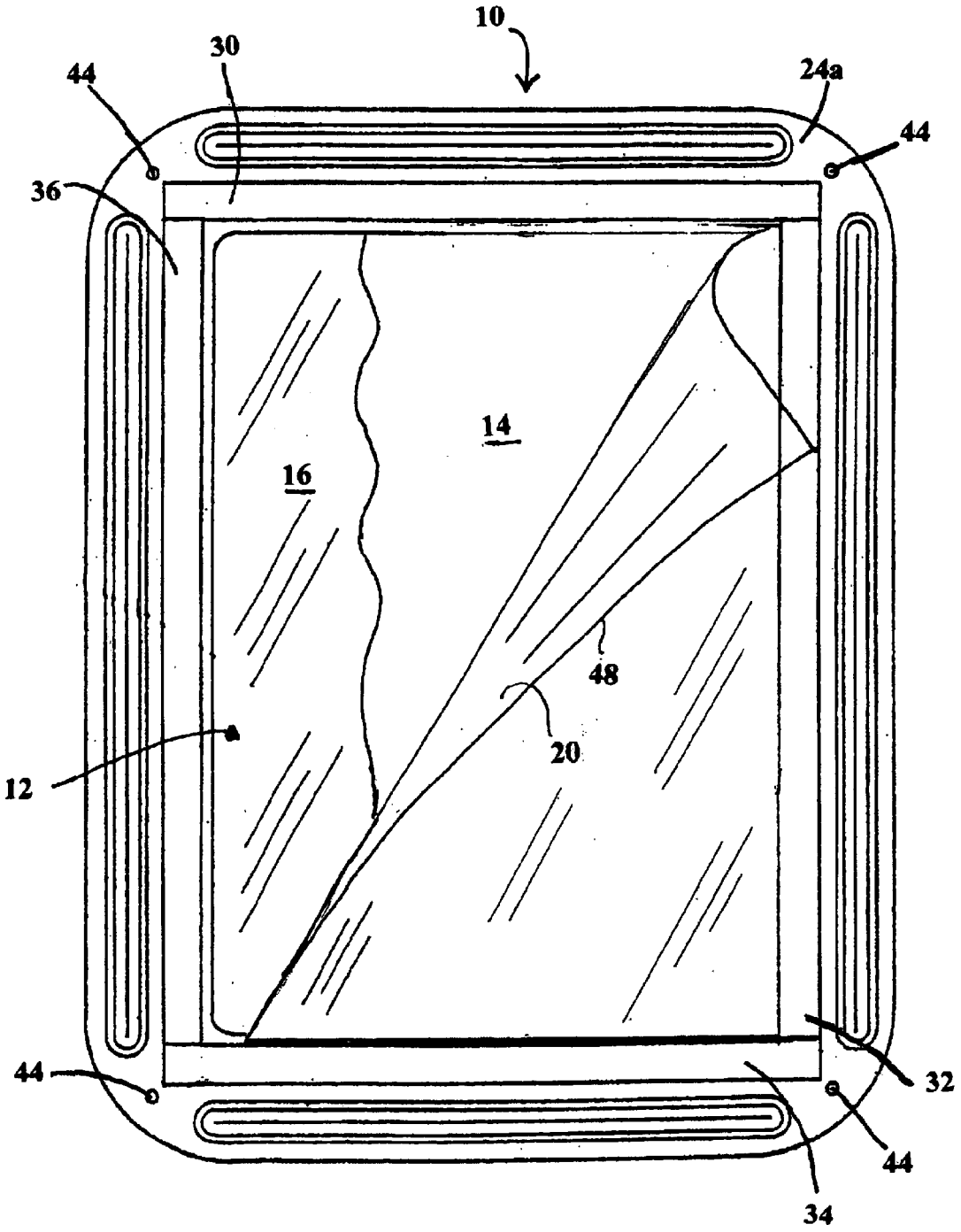
FIG. 4 is a view similar to FIG. 3, shown with the backing sheet partially raised to facilitate the installation of a sheet material to be displayed.
Figure 9:
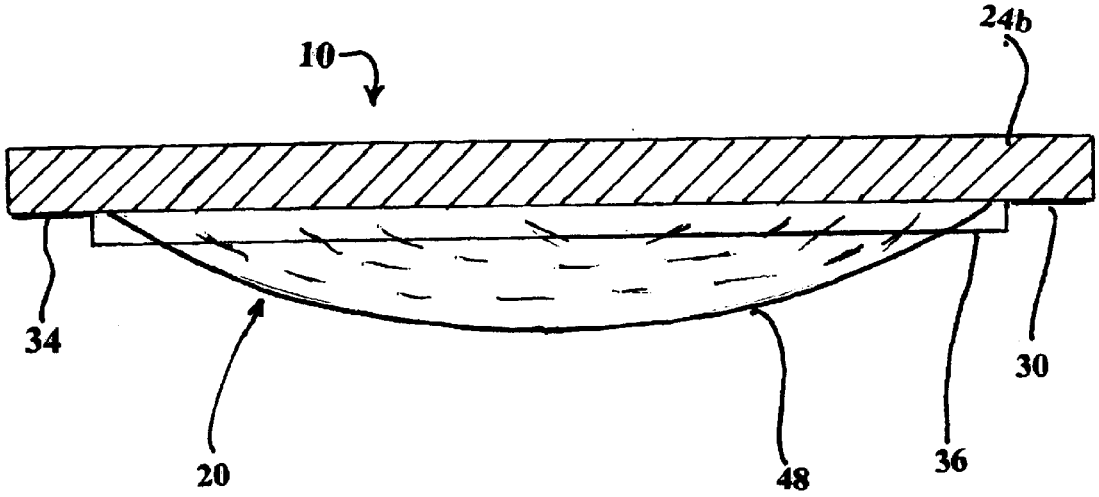
FIG. 9 is a sectional view taken generally along line 9—9 in FIG. 7, shown with the backing sheet partially raised.

To install a sheet material 14 for display, an edge 48 of the backing sheet 20, as viewed in FIG. 4 and FIG. 9, is raised and peeled back to expose the display section 16, the sheet material 14 to be displayed is laid against the back side of the display section 16 and the backing sheet 20 is released and falls back into place against the back side of the sheet material 14. The display device 10 can be placed against a ferrous surface such as a refrigerator, file cabinet, kitchen cabinet door, etc., if the suction cups 46 are not installed, or it can be placed against a non-ferrous surface such as a plastic-coated refrigerator, bedroom door, blackboard, window, etc. if the suction cups 46 are installed. Alternatively, the display device 10 can be hung on a hook, nail, screw or like device on a non-ferrous surface using hangers 50 that are integrally formed in the injection molded frame 24*a*.

The frame provides a decorative effect to the picture, artwork, or other sheet material being displayed. The front panel provides a smooth, flat surface on which the picture or the like is supported and also protects and preserves the picture. The backing sheet provides a simple means for retaining the sheet material in place in a unwrinkled or uncurled condition and for facilitating convenient removal and replacement of the sheet material.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A display device for sheet material, comprising:

(a) a transparent front panel adapted for displaying sheet material, said front panel having a central display section and a mounting section surrounding said central display section;

(b) a flexible backing sheet having a peripheral edge, at least a portion of said peripheral edge of said backing sheet being secured to said front panel mounting section, wherein sheet material to be displayed is inserted between said flexible backing sheet and said transparent front panel;

(c) a frame connected to said mounting section of said front panel opposite the backing sheet; and (d) mounting means connected to said frame, said mounting means including at least one hanger portion integral with said frame, each said hanger portion adapted for removably mounting said display devices on a surface.

2. The display device of claim 1, wherein said frame is formed by injection molded plastic.

3. The display device of claim 1, wherein said frame has at least one threaded aperture adapted for receiving a suction cup with a threaded screw, each said suction cup providing said mounting means.

4. The display device of claim 1, wherein said frame is a stamped foam rubber frame.

5. The display device of claim 1, wherein said mounting means includes at least one magnetic piece connected to said mounting section to provide a means for removably mounting said display device on a ferrous surface.

6. The display device of claim 5, wherein said at least one magnetic piece includes at least two magnetic strips, one of said magnetic strips being connected to one portion of said mounting section and the other of said magnetic strips being connected to another portion of said mounting section on an opposite end of said front panel.

7. The display device of claim 6, wherein each of said magnetic strips extends substantially along the entire length of one side of said display section.

8. The display device of claim 6, wherein said at least two magnetic strips are adhered to said mounting section of said front panel and to said frame using rubber cement.

9. The display device of claim 7, wherein said mounting section of said front panel is connected to said frame using said at least two magnetic strips and further using at least two opposing adhesive tape strips, said magnetic and tape strips also securing said at least a portion of said peripheral edge of said backing sheet to said mounting section.

10. The display device of claim 1, wherein said backing sheet covers a portion of said display section.

11. The display device of claim 1, wherein said backing sheet is opaque and entirely covers said display section.

12. The display device of claim 1, wherein said backing sheet and said transparent front panel is comprised of polyester film.

13. The display device of claim 1, further including means for securing at least one edge of said backing sheet on said mounting section of said front panel, said means for securing comprising an adhesive.

14. The display device of claim 13, wherein said adhesive is adhesive tape.

15. The display device of claim 13, wherein said adhesive is an adhesive magnetic strip.

16. The display device of claim 1, wherein said mounting means includes means for removably mounting said display device on a ferrous surface and means for removably mounting said display device on a non-ferrous surface.

17. A display device for sheet material, comprising:

(a) a transparent front panel adapted for displaying sheet material, said front panel having a central display section and a mounting section surrounding said central display section;

(b) a flexible backing sheet having a peripheral edge, at least a portion of said peripheral edge of said backing sheet being secured to said front panel mounting section, wherein sheet material to be displayed is inserted between said flexible backing sheet and said transparent front panel;

(c) a frame connected to said mounting section of said front panel; and (d) mounting means connected to said frame, said mounting means being adapted for removably mounting said display device on a surface, said mounting means including at least one magnetic piece connected to said frame to provide a means for removably mounting said display device on a ferrous surface.

* * * * *